US006650308B2

(12) United States Patent
Kawashima

(10) Patent No.: US 6,650,308 B2
(45) Date of Patent: Nov. 18, 2003

(54) ORGANIC EL DISPLAY DEVICE AND METHOD FOR DRIVING THE SAME

(75) Inventor: Shingo Kawashima, Tokyo (JP)

(73) Assignee: NEC Corporation, Tokyo (JP)

( * ) Notice: Subject to any disclaimer, the term of this patent is extended or adjusted under 35 U.S.C. 154(b) by 212 days.

(21) Appl. No.: 09/962,114

(22) Filed: Sep. 26, 2001

(65) Prior Publication Data

US 2002/0036605 A1 Mar. 28, 2002

(30) Foreign Application Priority Data

Sep. 28, 2000 (JP) ..... 2000-297498

(51) Int. Cl.[7] ..... G09G 3/03
(52) U.S. Cl. ..... 345/76; 315/169.3
(58) Field of Search ..... 245/76, 77, 80, 245/205, 214; 215/169.1, 169.3, 169.4; 313/582, 281

(56) References Cited

U.S. PATENT DOCUMENTS 6,084,579 A * 7/2000 Hirano ..... 345/205
6,208,083 B1 * 3/2001 Suzuki et al. ..... 315/169.3
6,316,879 B1 * 11/2001 Hitoshi ..... 315/169.3
6,496,168 B1 * 12/2002 Tomida ..... 345/76
6,534,925 B2 * 3/2003 Kawashima ..... 315/169.1
2002/0036605 A1 * 3/2002 Kawashima ..... 345/76
2002/0101179 A1 * 8/2002 Kawashima ..... 315/169.3
2003/0043137 A1 * 3/2003 Nakamura ..... 345/207

FOREIGN PATENT DOCUMENTS

JP 11-143429 5/1999

* cited by examiner

*Primary Examiner*—Amare Mengistu
(74) *Attorney, Agent, or Firm*—McGinn & Gibb, PLLC

(57) ABSTRACT

Organic EL elements are arranged in a matrix pattern. A column of organic EL elements are connected by their anodes to each data line. A row of organic EL elements are connected by their cathodes to each scanning line. In a data line driving circuit, a signal current source is connected to each data line, and each signal current source is connected to a power source. In a scanning line driving circuit switches are connected to each scanning line, with one end of each switch being connected to the power source, and the other end thereof being connected to the ground. The data lines are commonly connected to a Zener diode of a voltage retaining circuit via switches. A capacitor is connected in parallel to the Zener diode. The potential retained by the Zener diode is as high a potential as possible such that it is determined to be a black level of each color.

20 Claims, 8 Drawing Sheets

ORGANIC EL DISPLAY DEVICE AND METHOD FOR DRIVING THE SAME

BACKGROUND OF THE INVENTION

1. Field of the Invention

The present invention relates to an organic EL display device using organic EL (electro-luminescence) elements, and a method for driving the same.

2. Description of the Related Art

In a luminescent display device using organic EL elements, the organic EL elements are arranged in a matrix pattern. The organic EL elements are illuminated by, for example, successively scanning rows of elements in a column direction by means of a scanning line driving circuit (row driving circuit) and selectively supplying a driving current to the elements in a specified row selected by the row driving circuit. The driving current is supplied by means of a data line driving circuit (column driving circuit). Such an organic EL display device has been attracting public attention as a self-emissive display device which does not require a backlight.

FIG. 1 is a diagram illustrating a conventional passive matrix type organic EL display device. A plurality of organic EL elements 1 are arranged in a matrix pattern to form an organic EL panel 2. For the sake of simplicity, each organic EL element 1 is shown in FIG. 1 to be composed only of a diode. However, each organic EL element 1 includes a parasitic capacitor, arranged in parallel with the element 1, which has a very large electrostatic capacitance with respect to the current flowing through the element 1.

As illustrated in FIG. 1, a column of organic EL elements 1 are connected by their anodes to each data line 3 (3*a*, 3*b*, 3*c*, 3*d*, 3*e*, etc.). The data lines 3 are connected to a column driving circuit 5. A row of organic EL elements 1 are connected by their cathodes to each scanning line 4 (4*a*, 4*b*, 4*c*, 4*d*, etc.). The scanning lines 4 are connected to a row driving circuit 6. The data lines 3 can be selectively connected to the ground level via shunt switches 7 (7*a*, 7*b*, 7*c*, 7*d*, 7*e*, etc.). In the column driving circuit 5, each signal current source 8 is connected to a data line 3 via drive switches 9 (9*a*, 9*b*, 9*c*, 9*d*, 9*e*, etc.). Each scanning line 4 is connected to a scanning switch 10 of a plurality of scanning switches (10*a*, 10*b*, 10*c*, 10*d*, etc.) of the row driving circuit 6. The scanning lines 4 are selectively connected to either a power source V2 or the ground level via the scanning switches 10. The drive switches 9 of the column driving circuit 5, the scanning switches 10 of the row driving circuit 6 and the shunt switches 7 are controlled by a control circuit 11.

In the conventional organic EL display device with such a configuration, the control circuit 11 receives image display data and controls the row driving circuit 6 to successively scan the scanning lines 4. While a scanning line 4 is selected, the column driving circuit 5 supplies a predetermined current as the driving current to a particular selected data line 3. In this way the organic EL element 1, which is connected to the selected scanning line 4 and the selected data line 3, is illuminated. For example, while the row driving circuit 6 is scanning the scanning line 4*b*, the organic EL elements 1 connected to the data lines 3*b* and 3*c*, among the organic EL elements 1 connected to the scanning line 4*b*, can be illuminated by controlling the row driving circuit 6 to switch the scanning switch 10*b* to the ground side and switching the scanning switches 10*a*, 10*c*, 10*d*, etc., connected to the other scanning lines 4*a*, 4*c*, 4*d*, 4*e*, etc., to the power source V2 side. The column driving circuit 5 applies a power source V1 from the signal current source 8 to the data lines 3*b* and 3*c* by turning OFF the shunt switches 7*b* and 7*c* and turning ON the driving switches 9*b* and 9*c*. The column driving circuit 5 then connects the data lines 3*a*, 3*d* and 3*e* to a ground by turning ON the shunt switches 7*a*, 7*d*, 7*e*, etc., and turning OFF the driving switches 9*a*, 9*d* and 9*e*. At the same time the scanning line 4*b* is at the ground potential. In this way, the driving current supplied from the signal current source 8 to the data lines 3*b* and 3*c*, based on the potential difference between the power source V1 and the ground, flows through the organic EL elements 1 connected between the data lines 3*b* and 3*c* and the scanning line 4*b*. In this way the elements 1 are illuminated.

The elements 1 which are connected to the data lines 3*b* and 3*c* and to the other scanning lines 4*a*, 4*c*, 4*d*, 4*e*, etc., have their cathodes connected to the power source V2 via the scanning switches 10*a*, 10*c*, 10*d*, 10*e*. In this way the power source V1 is applied to the anodes of the elements 1 via the data lines 3*b* and 3*c* while the power source V2 is applied, as a reverse bias, to the cathodes of the elements 1 via the scanning lines 4*a*, 4*c*, 4*d*, 4*e*, etc. Since the voltages of the power source V1 and the power source V2 are set at similar levels, there is no voltage difference applied between the anode and the cathode of such elements 1. Consequently, the elements 1 are not illuminated.

The organic EL elements 1 which are connected to the scanning line 4*b* and to the other data lines 3*a*, 3*d*, 3*e*, etc., have their anodes and cathodes both grounded, and there is no voltage difference between them. Consequently, such elements 1 are not illuminated.

The power source V2 is applied to the cathodes and the ground potential is applied to the anodes of the organic EL elements 1 which are connected between the other data lines 3*a*, 3*d*, 3*e*, etc., and the other scanning lines 4*a*, 4*c*, 4*d*, etc. Consequently, a voltage difference in the opposite direction is applied to the elements 1. Therefore, a current does not flow through such elements 1, and the elements 1 are not illuminated. However, since a voltage difference in the opposite direction is applied to the elements 1, the parasitic capacitors of the elements 1 are charged in an opposite direction to the direction in which the parasitic capacitors of the illuminated elements 1 are charged.

In a case where the data lines 3*a*, 3*d* and 3*e*, which have not been driven in the previous scanning step, are driven in the next scanning step, in other words in a case where the data lines 3*a*, 3*d* and 3*e*, which have not been driven while scanning the scanning line 4*b*, are driven when the scanning operation proceeds to the scanning line 4*c*, a current of course flows through the organic EL elements 1 that are connected to the scanning line 4*c* and are to be illuminated. A current also flows through the organic EL elements 1 that are not connected to the scanning line 4*c* but have been charged in the reverse direction in the previous scanning step so as to cancel out the reverse charge. Therefore, it takes a long time to charge the organic EL elements 1 to be illuminated, and the current cannot be raised quickly.

In view of this, in the prior art, when the scanning operation by the row driving circuit 6 proceeds from the scanning line 4*b* to the next scanning line 4*c*, all of the driving switches 9*a*, etc., of the column driving circuit 5 are turned OFF. At the same time all of the scanning switches 10*a*, etc., of the row driving circuit 6 and all of the shunt switches 7*a*, etc., are connected to a ground or the power source. As a result the charge stored in the organic EL elements 1 is discharged. In this way, selected organic EL elements 1 are illuminated by applying a constant pixel current to the selected organic EL elements 1 after discharging all of the parasitic capacitors. The unnecessary charging of the organic EL elements 1 is consequently avoided.

While the current-voltage characteristics of the organic EL element 1 are conceptually close to those of a light emitting diode, the voltage at which the current rises is as high as about 5 to 10 V for the organic EL element 1, whereas it is about 2 V for a light emitting diode. Moreover, unlike a light emitting diode, while the organic EL element 1 requires a very small current to be illuminated, the electrostatic capacitance of the parasitic capacitor arranged in parallel to the organic EL element 1 is very large, as described above. Therefore, while increasing the voltage applied to the organic EL element 1 to a voltage at which the current rises, the parasitic capacitor is charged. In this way the increase of the voltage for the organic EL element 1 to be illuminated is delayed.

As described above, in the conventional driving circuit, when the scanning operation proceeds from one scanning line to another, all of the scanning lines 4*a,* etc., and all of the data lines 3*a,* etc., are connected to a ground or the power source. In this way the parasitic capacitors present in the organic EL panel 2 are discharged completely, and the parasitic capacitor is charged from 0 V to a voltage at which illumination can be obtained in the following scanning step. Therefore, it requires a long time to charge the parasitic capacitor before the organic EL element 1 starts to be illuminated. Because the charge time is long, it is not possible to obtain an effective illumination time during which a current that is required to brightly illuminate the organic EL element 1 can be applied. Consequently, it is not possible to ensure a sufficient brightness.

In order to solve this problem, there has been proposed a method for driving a luminescent display in which an offset voltage is applied to, and charges, the light emitting elements during a period after the scanning of a scanning line is completed, and before the scanned line is switched to the next scanning line (Japanese Patent Laid-Open Publication No. Hei. 11-143429).

However, the conventional method for driving an organic EL display device requires a constant offset voltage source which is applied to all of the light emitting elements during a period after the scanning of a scanning line is completed and before the next scanning step.

SUMMARY OF THE INVENTION

The object of the present invention is to provide an organic EL display device, and a method for driving the same, in which a constant voltage source is not required and which is capable of being illuminated quickly with a simple circuit configuration. It is also the object to increase the brightness of the illumination while improving the current efficiency by collecting the charge of the parasitic capacitor.

An organic EL display device according to the present invention comprises: a plurality of organic EL elements arranged in a matrix pattern; a plurality of scanning lines each connected to a row of the organic EL elements; a plurality of data lines each connected to a column of the organic EL elements; a scanning line driving circuit for successively scanning the scanning lines; a data line driving circuit for applying a driving current to a selected data line in synchronization with the scanning operation of the scanning line driving circuit; a Zener diode capable of retaining a voltage in a range for a black level of the organic EL elements; a switch provided between each of the data lines and the Zener diode for either commonly connecting the data lines to the Zener diode or disconnecting the data lines from one another and from the Zener diode; and a control circuit for turning ON all of the switches to connect all of the data lines to one another and to the Zener diode when the scanning operation by the scanning line driving circuit proceeds from one scanning line to the next scanning line.

The method for driving an organic EL display device according to the present invention employ a device which device comprises: a plurality of organic EL elements arranged in a matrix pattern; a plurality of scanning lines each connected to a row of the organic EL elements; a plurality of data lines each connected to a column of the organic EL elements; a scanning line driving circuit for successively scanning the scanning lines; a data line driving circuit for applying a driving current to a selected data line in synchronization with the scanning operation by the scanning line driving circuit; a Zener diode capable of retaining a voltage in a range for a black level of the organic EL elements; and a switch provided between each of the data lines and the Zener diode. In the method, all of the switches are turned on to connect all of the data lines to one another and to the Zener diode so as to charge parasitic condensers of the organic EL elements to a voltage that is determined by the Zener diode when the scanning operation by the scanning line driving circuit proceeds from one scanning line to the next scanning line.

According to the present invention, when the scanning operation by the scanning line driving circuit proceeds from one scanning line to the next scanning line, all of the switches are turned ON. This is done so that the data lines are connected to one another and to commonly connect the data lines to the Zener diode immediately before applying a driving current to the data lines. Thus, the charge stored in the parasitic capacitors from pixels that have been illuminated during the previous scanning step is allowed to flow into the parasitic capacitors of all of the pixels via the data lines, so as to charge the parasitic capacitors. Thus, the organic EL element of each pixel is charged to a voltage that is determined by the Zener diode.

DETAILED DESCRIPTION OF THE PREFERRED EMBODIMENTS

Embodiments of the present invention will now be described with reference to the accompanying drawings.

Figure 1:
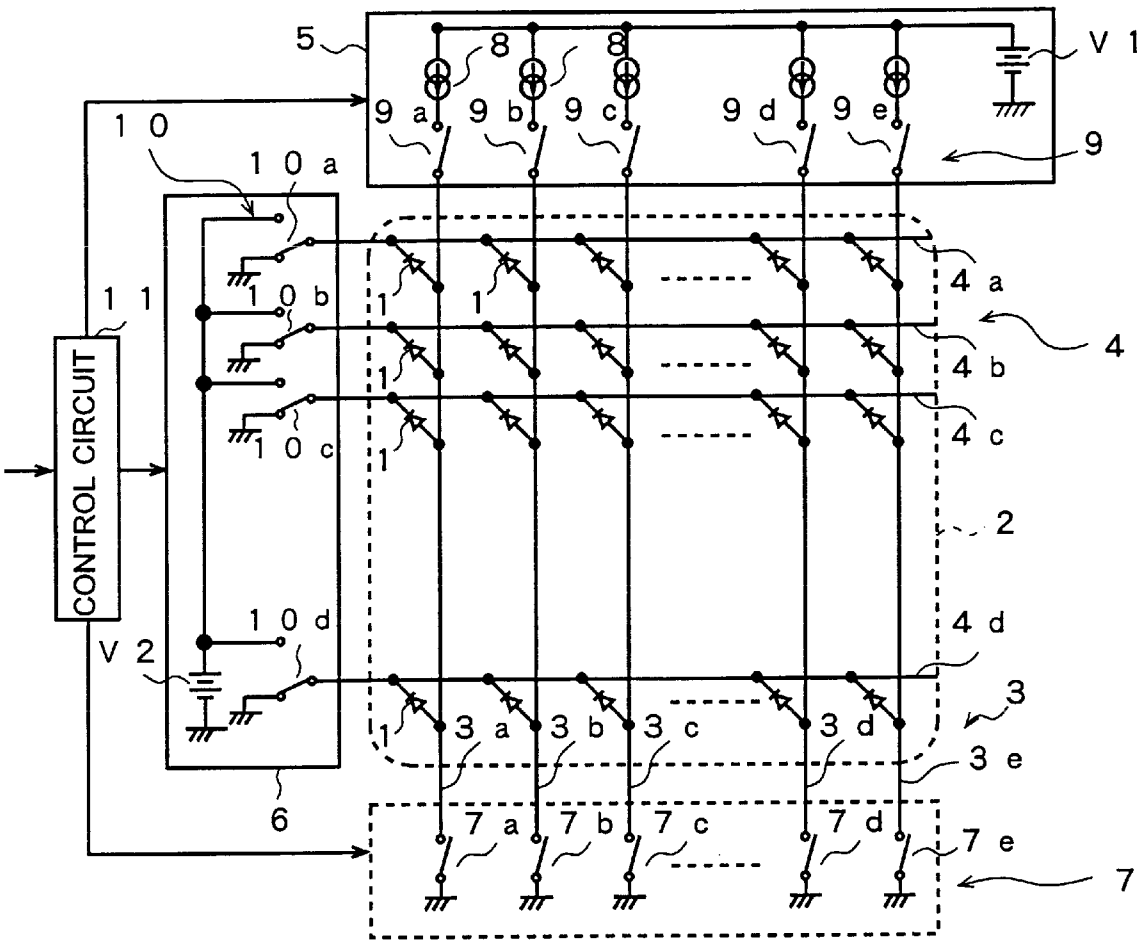
FIG. 1 (PRIOR ART)
FIG. 1 is a block diagram illustrating a conventional organic EL display device.
Figure 2:
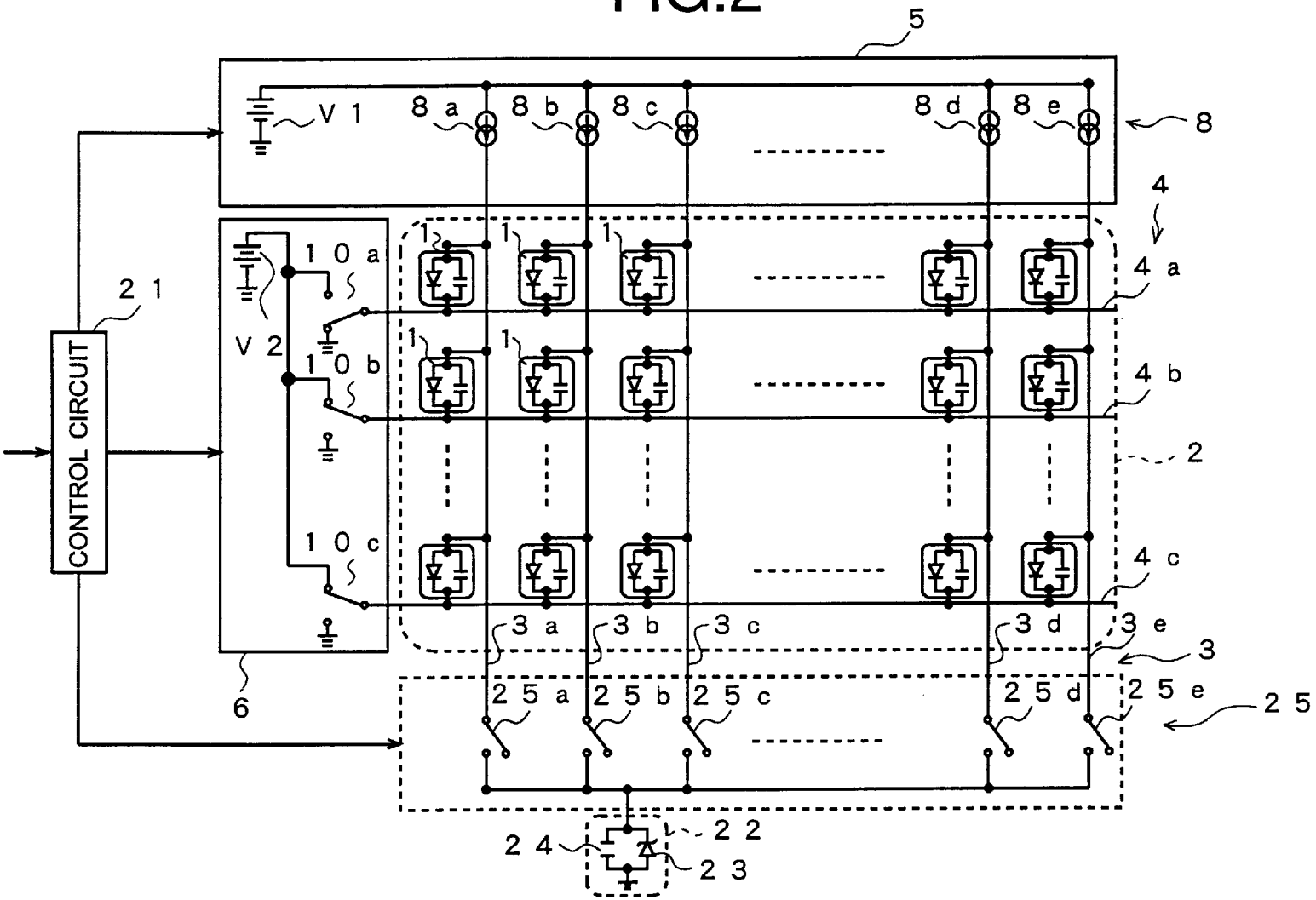
FIG. 2 is a block diagram illustrating an organic EL display device according to an embodiment of the present invention.

FIG. 2 is a circuit diagram illustrating an organic EL display device according to an embodiment of the present invention. Organic EL elements 1 are arranged in a matrix pattern, forming an organic EL panel 2. Each organic EL element 1 includes a diode and a parasitic capacitor connected in parallel to the diode. A column of organic EL elements 1 are connected by their anodes to each data line 3 (3*a*, 3*b*, 3*c*, 3*d*, 3*e*, etc.). The data lines 3 (3*a*, 3*b*, 3*c*, 3*d*, 3*e*, etc.) extend in the column direction in parallel with one another. A row of organic EL elements 1 are connected by their cathodes to each scanning line 4 (4*a*, 4*b*, 4*c*, etc.). The scanning lines 4 (4*a*, 4*b*, 4*c*, etc.) extend in the row direction in parallel with one another. The data lines 3 (3*a*, 3*b*, 3*c*, 3*d*, 3*e*, etc.) and the scanning lines 4 (4*a*, 4*b*, 4*c*, etc.) are made of a transparent conductive film such as ITO (Indium-Tin-Oxide).

Each data line 3 (3*a*, 3*b*, 3*c*, 3*d*, 3*e*, etc.) is connected to a data line driving circuit 5. In the data line driving circuit 5, signal current sources 8 (8*a*, 8*b*, 8*c*, 8*d*, 8*e*, etc.) are connected to the data lines 3 (3*a*, 3*b*, 3*c*, 3*d*, 3*e*, etc.) respectively, and the signal current sources 8 (8*a*, 8*b*, 8*c*, 8*d*, 8*e*, etc.) are connected to the power source V1.

The scanning lines 4 (4*a*, 4*b*, 4*c*, etc.) are connected to a scanning line driving circuit 6. In the scanning line driving circuit 6, switches 10*a*, 10*b*, 10*c*, etc., are connected to the scanning lines 4 (4*a*, 4*b*, 4*c*, etc.) respectively. One end of each of the switches 10*a*, 10*b*, 10*c*, etc., is connected to a power source V2, and the other end thereof is connected to the ground.

The data lines 3 (3*a*, 3*b*, 3*c*, 3*d*, 3*e*, etc.) are commonly connected to a voltage retaining circuit 22 via switches 25 (25*a*, 25*b*, 25*c*, 25*d*, 25*e*, etc.) respectively. The voltage retaining circuit 22 includes a Zener diode 23 and a capacitor 24 connected in parallel to the Zener diode 23. An anode of the Zener diode 23 is connected to the data lines 3 (3*a*, 3*b*, 3*c*, 3*d*, 3*e*, etc.), and a cathode of the Zener diode 23 is connected to the ground. The switches 25 (25*a*, 25*b*, 25*c*, 25*d*, 25*e*, etc.) turns ON/OFF the connection between the data lines 3 (3*a*, 3*b*, 3*c*, 3*d*, 3*e*, etc.), respectively, and the voltage retaining circuit 22. The potential of the Zener diode 23 is as high a potential as possible so that it is determined to be a black level of each color.

The output of the signal current sources 8 (8*a*, 8*b*, 8*c*, 8*d*, 8*e*, etc.) of the data line driving circuit 5, the ON/OFF of the switches 10*a*, 10*b*, 10*c*, etc., of the scanning line driving circuit 6, and the ON/OFF of the switches 25 (25*a*, 25*b*, 25*c*, 25*d*, 25*e*, etc.) of the switch circuit are controlled by a control circuit 21 to which illumination data is input.

The organic EL display device includes the organic EL panel 2, the data line driving circuit 5, the scanning line driving circuit 6, a switch circuit 25, and the voltage retaining circuit 22, each with a configuration as illustrated in FIG. 2 for each green (G), blue (B) and red (R) illumination color.

Next, the operation of the organic EL display device of the present embodiment with such a configuration will be described along with the control operation by the control circuit 21. When the operation of the scanning line driving circuit 6 is switched from the scanning of the scanning line 4*c* to the scanning of the scanning line 4*a*, the control circuit 21 turns the switch 10*a* of the scanning line driving circuit 6 to the ground side while turning the other switches 10*b*, 10*c*, etc., to the power source V2 side. This is illustrated in FIG. 2. Then, in a case where the organic EL elements 1 connected to the data lines 3*b* and 3*c*, among the organic EL elements 1 connected to the scanning line 4*a*, are illuminated, an illumination level current is output from the signal current sources 8*b* and 8*c*.

In this way, each of the signal current sources 8*b* and 8*c* produce a current flowing through one of the organic EL elements 1 connected between the data lines 3*b* and 3*c* and the scanning line 4*a*. The current flows from the data lines 3*b* and 3*c* to the scanning line 4*a*, thereby illuminating the organic EL elements 1. At the same time, the parasitic capacitor of each of the illuminated organic EL elements 1 is charged in the forward direction. For the other scanning lines 4*b* and 4*c*, the switches 10*b* and 10*c* are connected to the power source V2 side. Therefore, by setting the voltage of the power source V1 and the voltage of the power source V2 to a similar level the organic EL elements 1 connected between the data lines 3*b* and 3*c* and the other scanning lines 4*b* and 4*c* will not be illuminated. The parasitic capacitors of these organic EL elements 1 are charged to a reverse bias potential according to the magnitude of the driving current. The organic EL elements 1 connected between the other data lines 3*a*, 3*d* and 3*e* and the scanning line 4*a* will not be illuminated because the signal current sources 8*a*, 8*d* and 8*e* do not supply the driving current. The parasitic capacitors of these organic EL elements 1 are not charged/discharged. The anodes of the organic EL elements 1 which are connected between the other scanning lines 4*b* and 4*c* and the other data lines 3*a*, 3*d* and 3*e* are not supplied with a driving current and the cathodes of the organic EL elements 1 are connected to the power source V2. In this way these organic EL elements 1 are reverse biased with a voltage difference in the reverse direction applied to the opposite sides of the organic EL elements 1. Thus, since these organic EL elements 1 are reverse biased, the organic EL elements 1 will not be illuminated. The parasitic capacitors of these organic EL elements 1 are charged to a negative reverse bias potential.

Figure 3:
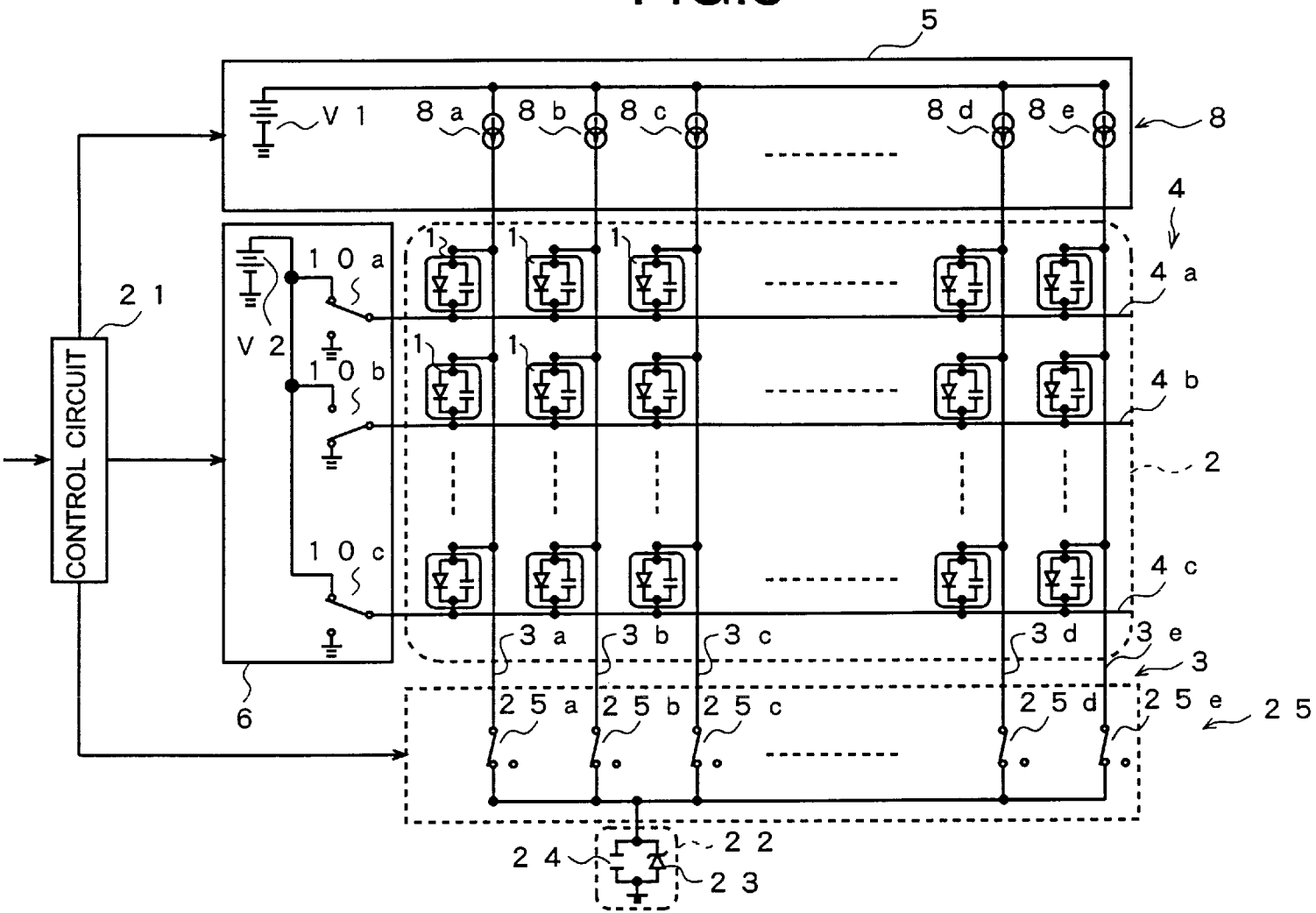
FIG. 3 is a block diagram illustrating an operation of the embodiment.

Then, when the scanning operation proceeds from the scanning line 4*a* to the scanning line 4*b*, the control circuit 21 connects the switch 10*b* of the scanning line driving circuit 6 to the ground while connecting the other switches 10*a* and 10*c* to the power source V2 side. This is illustrated in FIG. 3. Moreover, the switches 25 (25*a*, 25*b*, 25*c*, 25*d*, 25*e*, etc.) are all connected to the voltage retaining circuit 22. As a result, all of the data lines 3 (3*a*, 3*b*, 3*c*, 3*d*, 3*e*, etc.) are connected to one another, whereby charges flow from the illuminated pixels to all the pixels via the data lines 3 (3*a*, 3*b*, 3*c*, 3*d*, 3*e*, etc.). Thus, the parasitic capacitors of all of the organic EL elements 1 are charged with the charges flowing into the parasitic capacitors, whereby all of the data lines 3 (3*a*, 3*b*, 3*c*, 3*d*, 3*e*, etc.) are at a potential that is determined by the Zener diode 23 of the voltage retaining circuit 22. Moreover, the capacitor 24 connected in parallel to the Zener diode 23 is also charged to the same potential as the data lines 3 (3*a*, 3*b*, 3*c*, 3*d*, 3*e*, etc.). The potential of the Zener diode 23 is as high a potential as possible such that it is determined to be a black level of each color. Thus, the parasitic capacitor of the organic EL element 1 of each pixel is charged to a potential that is determined by the Zener diode 23.

Figure 4:
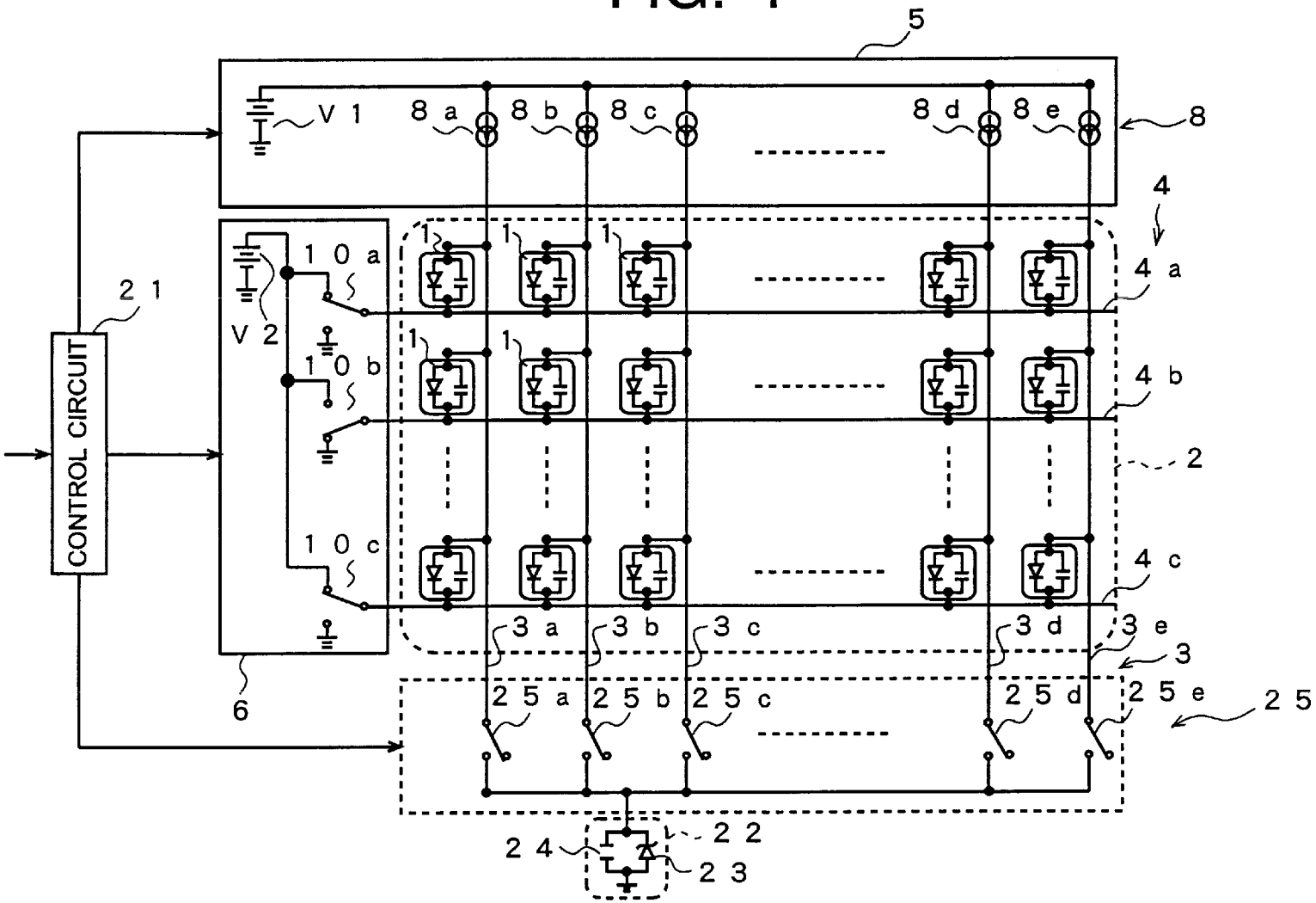
FIG. 4 is another block diagram illustrating an operation of the embodiment.

Then, as illustrated in FIG. 4, the control circuit 21 turns OFF all of the switches 25 (25*a*, 25*b*, 25*c*, 25*d*, 25*e*, etc.) so as to disconnect the data lines 3 (3*a*, 3*b*, 3*c*, 3*d*, 3*e*, etc.) from one another while disconnecting the data lines from the voltage retaining circuit 22. At the same time, in a case where the organic EL elements 1 to be illuminated, among the organic EL elements 1 connected to the scanning line 4*b*, are those organic EL elements 1 connected to the data lines 3*d* and 3*e* and the scanning line 4*b*, the driving current is allowed to flow from the signal current sources 8*d* and 8*e*, with the other signal current sources 8*a*, 8*b* and 8*c* being turned OFF. As a result, a potential difference based on the current value of the signal current sources 8*d* and 8*e* is applied in the forward direction to the organic EL elements 1 connected to the data lines 3*d* and 3*e* and the scanning line 4*b*. In this way these organic EL elements 1 are illuminated. In such a case, since the parasitic capacitors of the organic EL elements 1 have already been charged to a potential that is determined by the potential of the Zener diode 23, the parasitic capacitors need to be charged with only a small amount of charge to illuminate the organic EL elements 1. Therefore, these pixels are illuminated very quickly after the switch 25 is turned OFF. For pixels to which a signal current is not supplied, the parasitic capacitors of the organic EL elements 1 are charged with either no charge or with a reverse charge (reverse bias charge), as described above.

Figure 5:
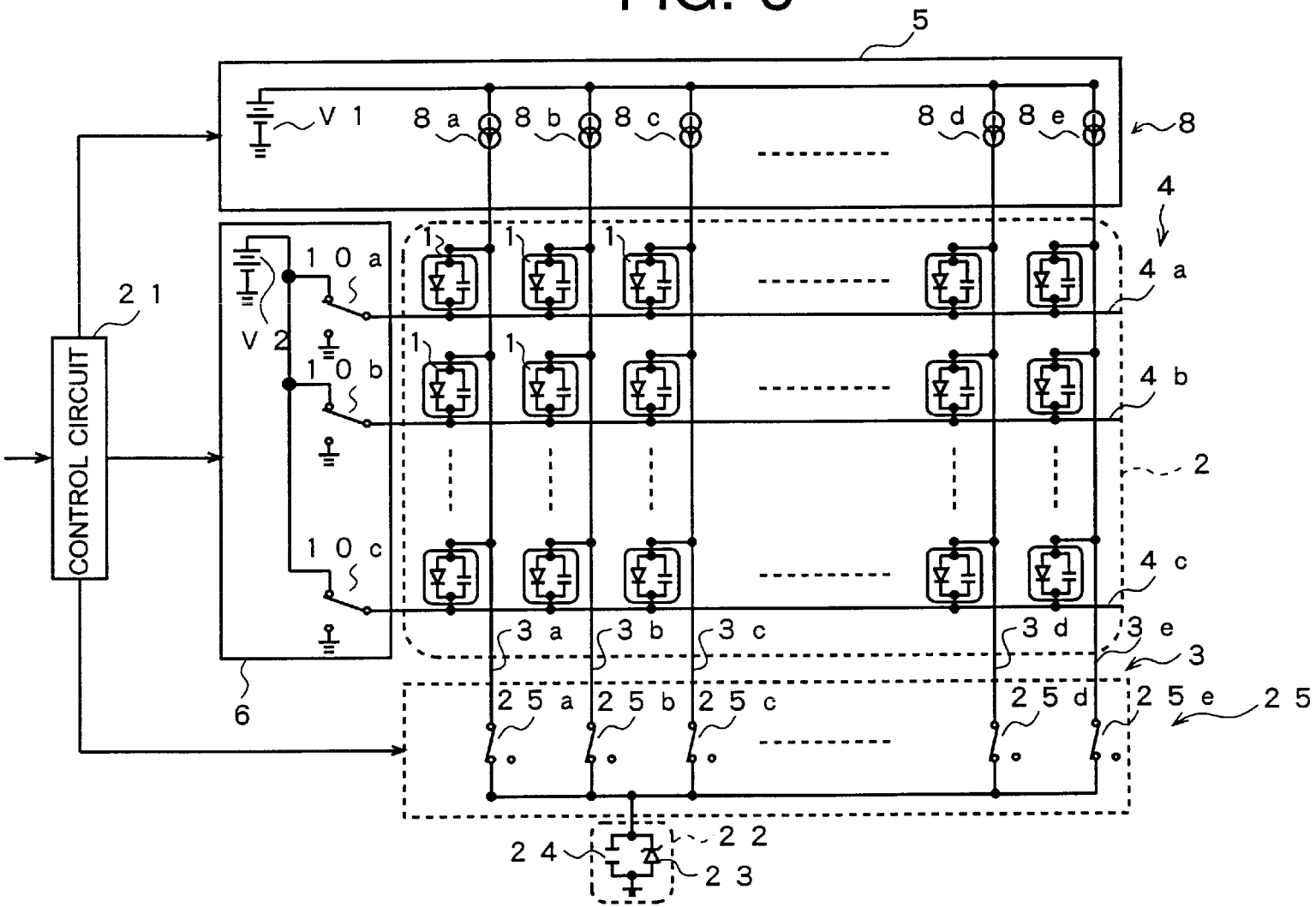
FIG. 5 is still another block diagram illustrating an operation of the embodiment.

Then, when the scanning operation proceeds to the next scanning line, the switches of the next scanning line (not shown in FIG. 5) are grounded, and all of the switches 25 (25*a*, 25*b*, 25*c*, 25*d*, 25*e*, etc.) are connected to the voltage retaining circuit 22 side, as illustrated in FIG. 5. Thus, charges flow from the illuminated pixels to all the pixels, whereby the parasitic capacitors of the organic EL elements 1 of all of the pixels are charged to a potential that is determined by the potential of the Zener diode 23. In such a case, even if the charge stored in the parasitic capacitors of the organic EL elements 1 of the illuminated pixels is not sufficient to charge the parasitic capacitors of the organic EL elements 1 of all of the pixels to the potential determined by the Zener diode 23, a charge is also supplied from the capacitor 24. In this way the parasitic capacitors of all of the pixels are charged with a charge that is determined by the potential of the Zener diode 23.

Therefore, when the data line driving circuit 5 drives a predetermined data line with a signal from the control circuit 21, the voltage difference between the opposite sides of each of the organic EL elements 1 of those pixels to be illuminated increases to a desired brightness level very quickly. This is because the parasitic capacitors of the organic EL elements 1 of all of the pixels have been charged to a black level.

As described above, according to the present embodiment, it is possible, with the simple circuit configuration including the Zener diode, the capacitor, and the ON/OFF switch, without a constant voltage source, to quickly illuminate the organic EL elements 1. In this way a sufficiently high current can be applied to the organic EL elements 1, thus obtaining a high level of brightness. Moreover, the charge with which the organic EL elements 1 are charged to a black level is supplied from the parasitic capacitors of those organic EL elements 1 that have been illuminated in the previous scanning step. Thus, the charge to a black level is done by using the collected charge, thereby making effective use of the charge, and avoiding the wasteful current consumption for charging the parasitic capacitors.

While the voltage retaining circuit 22 includes the Zener diode 23 and the capacitor 24 connected in parallel to each other in the present embodiment, the capacitor 24 does not always have to be provided. The parasitic capacitor of the organic EL element 1 of each pixel has a large capacitance value. Because of this the large amount of charge stored in the parasitic capacitors of the organic EL elements 1 of the pixels that have been illuminated in the previous scanning step is supplied to the parasitic capacitors of all of the organic EL elements 1 through the data lines 3 (3*a*, 3*b*, 3*c*, 3*d*, 3*e*, etc.). Therefore, the capacitor 24 does not need to be charged. However, in a case where an image to be displayed is such that only a small number of pixels are illuminated, for example, it is preferred that the capacitor 24 is provided. In this case the capacitor 24 is also charged with the charge stored in the parasitic capacitors of the pixels illuminated in the previous scanning step so that the capacitor 24 also supplies a charge in the following scanning step. In this way the organic EL element 1 of each pixel is stably charged to a black level.

As described above, in the present embodiment, the Zener diode 23 connected in parallel with the voltage retaining capacitor 24 generating a bias voltage is charged by using a charge that has been stored in the parasitic capacitors of the pixels in the previous scanning step. The voltage of the organic EL element 1 when OFF, though it varies substantially depending upon the material used for the organic EL element 1, is typically 5 to 10 V. This voltage is substantially larger than that of a light emitting diode, which is a commonly-employed current light emitting element. On the other hand, an organic EL element inevitably has a relatively large parasitic capacitor due to its structure. Therefore, with an organic EL display driving circuit of a current driving type that outputs a constant current, it takes a long time before the voltage increases to a level sufficient to obtain a desired brightness. In this way the effective illumination time for which a pixel is illuminated with a desired brightness is reduced. In contrast, according to the present embodiment, when the scanning operation proceeds to the next scanning line, an organic EL element, immediately before it is driven, is charged with the element's black level voltage. That is to say, an organic EL element is charged with a voltage of a level that is slightly lower than that of the voltage at which the element is illuminated, whereby the element is illuminated within a short period of time upon application of a driving current thereto. According to the present invention, in order to drive the organic EL elements in this way, instead of a constant voltage source, the charge, which has been stored in the parasitic capacitors of the organic EL elements in the previous scanning step, is collected and used to charge the parasitic capacitor of each organic EL element. This takes place when the operation proceeds to the next scanning step so that the potential difference between the opposite sides of the organic EL element is equal to a potential that is determined by the Zener diode. In this way, in the following scanning step, after starting the driving operation the organic EL element is illuminated very quickly and the current thereof quickly increases to a level sufficient to obtain a desired high level of brightness. The high level of brightness is retained over a long period of time. Thus, according to the present invention, it is possible to elongate the effective illumination time with the simple configuration, and to retain a high level of brightness.

Figure 6:
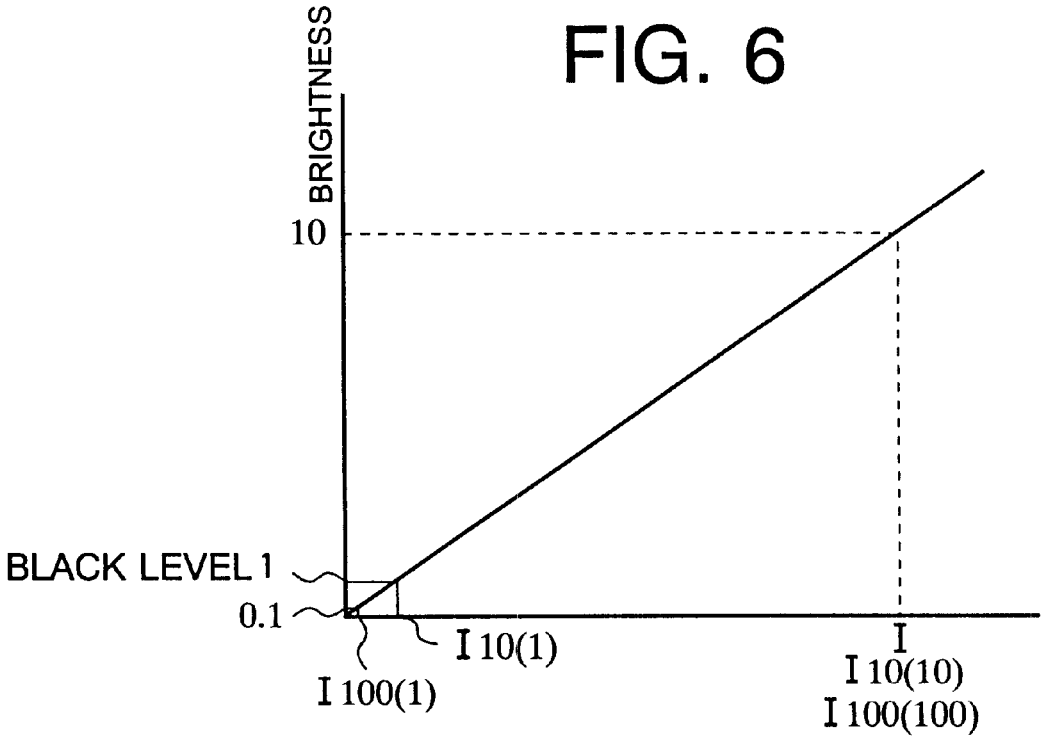
FIG. 6 is a diagram illustrating a retained voltage of a voltage retaining circuit.
Figure 7:
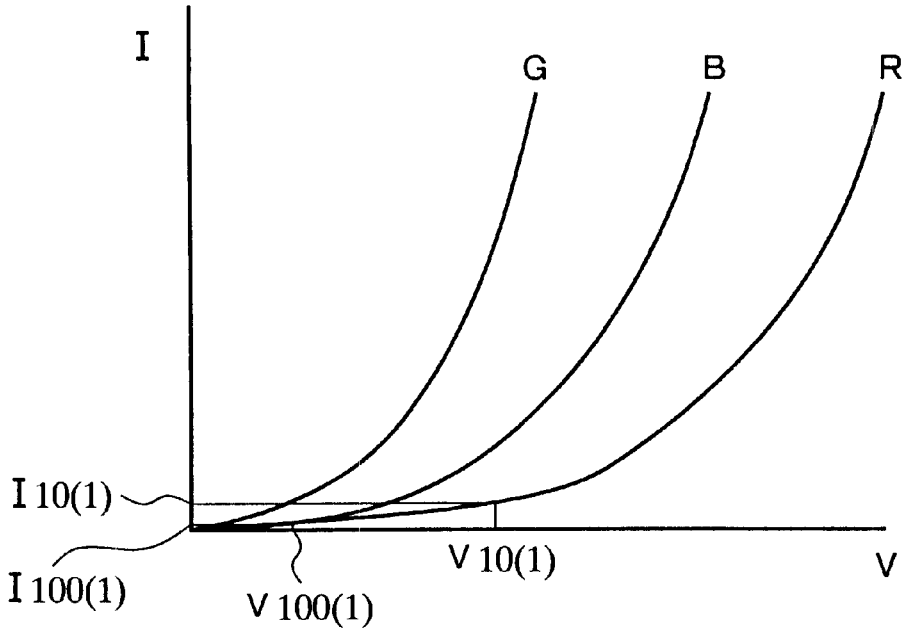
FIG. 7 is another diagram illustrating a retained voltage of the voltage retaining circuit.

The potential of the Zener diode 23 is as high a potential as possible and is a black level of the organic EL element of the illumination color of the pixel. FIG. 6 is a graph illustrating the relationship between the brightness of an organic EL element and a driving current, with the horizontal axis representing the current flowing through the organic EL element, and the vertical axis representing the brightness. FIG. 7 is a graph illustrating the relationship between the potential difference and the driving current, with the horizontal axis representing the potential difference in an organic EL element, and the vertical axis representing the driving current of the organic EL element. As illustrated in FIG. 6, the driving current and the illumination brightness are in a proportional relationship. With the highest brightness being 10 in an exponential expression and the driving current at the highest brightness being I10(10). The black level is 1 when the contrast is set to 10. With the driving current at that time being I1, the potential difference of the black level at a contrast of 10 is V10(1) when the illumination color is red (R), as illustrated in FIG. 7. As illustrated in FIG. 7, the relationship between the driving current and the potential difference varies for different illumination colors. Therefore, since the potential difference at the black level varies for different illumination colors, it is necessary to set the retained voltage of the Zener diode illustrated in FIG. 2 to an appropriate value according to the illumination color. Moreover, the retained voltage of the Zener diode also varies depending upon the desired contrast of the display device. In FIG. 6, when the contrast is 100, the black level is 0.1, with the highest brightness being 10. The black level driving current I100(1) at a contrast of 100 is 1/10 of I10(1), and the potential difference of the organic EL element at the black level is V100(1), as illustrated in FIG. 7. Therefore, the black level voltage varies depending upon the illumination color and the desired contrast. Therefore, while the voltage to be stored in the Zener diode is as high a potential difference as possible among the black level potential differences, it is appropriately determined depending upon the illumination color and the desired contrast.

Figure 8:
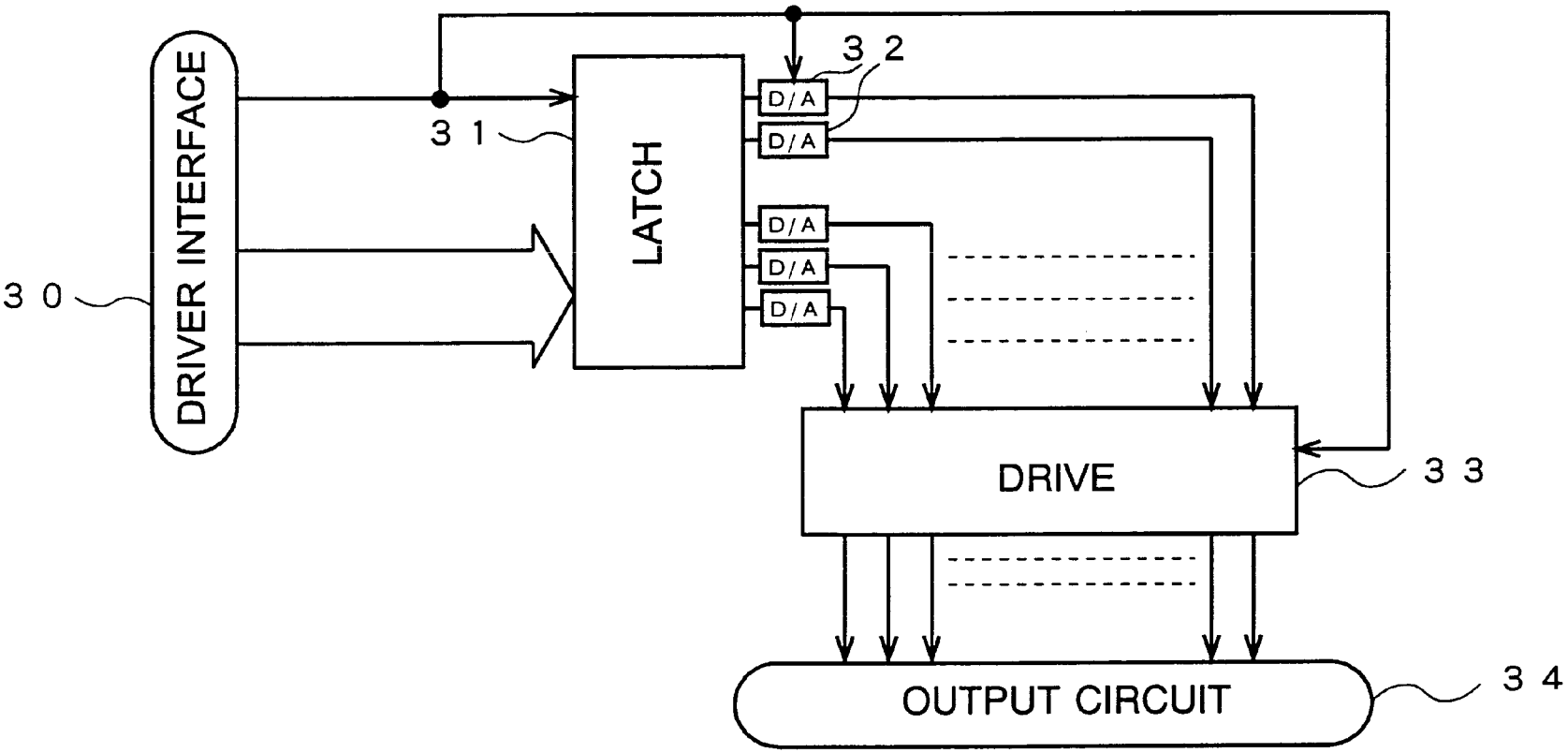
FIG. 8 is a block diagram illustrating an example of a circuit configuration of a data line driving circuit.
Figure 9:
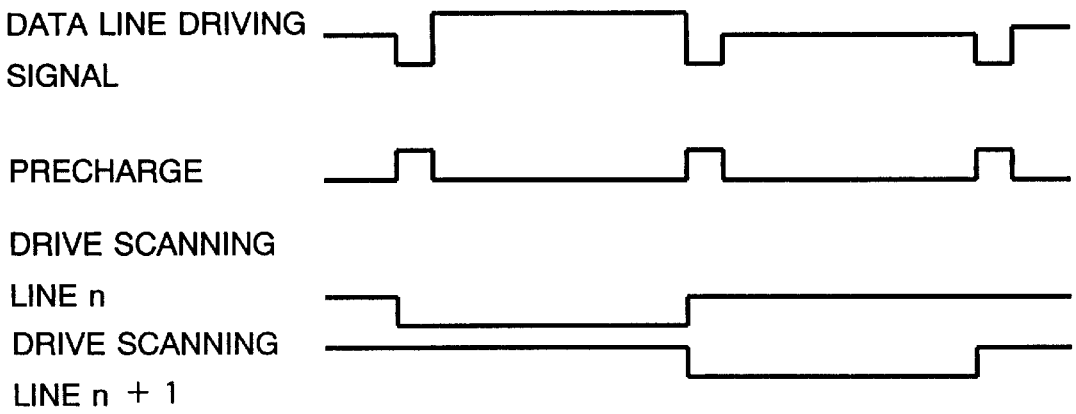
FIG. 9 is a timing chart illustrating a column-row timing.
Figure 10:
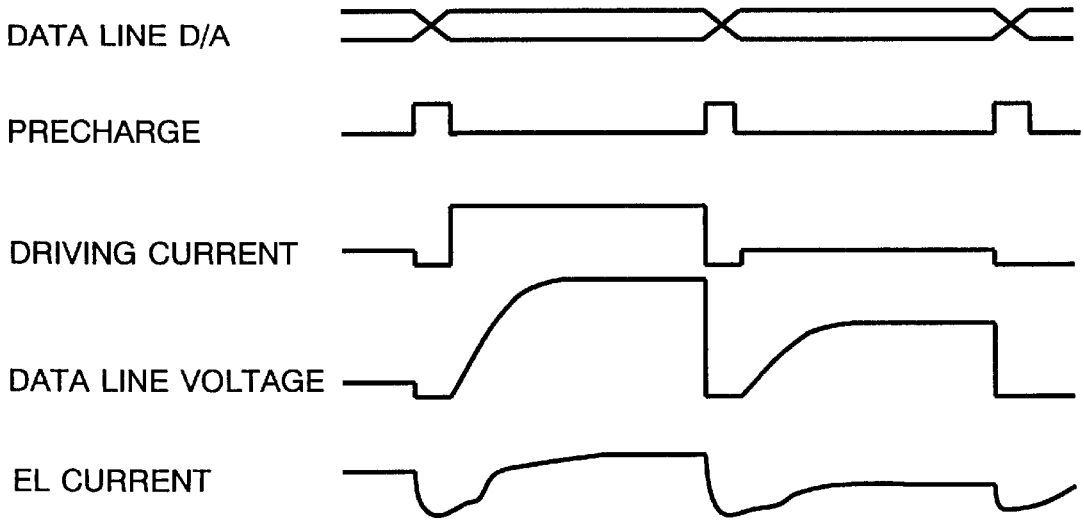
FIG. 10 is a timing chart illustrating a column timing.

The circuit configuration of the data line driving circuit and the method by which the data line driving circuit supplies the driving current are as in the prior art. FIG. 8 is a block diagram illustrating an example of a circuit configuration of the data line driving circuit, and FIG. 9 and FIG. 10 are timing charts illustrating the column-row timing and the column timing respectively. The driving signal input to a driver interface 30 is input to and latched by a latch 31, and the driving signal latched by the latch 31 is output to a drive 33 via a D/A converter 32. Moreover, a control signal is output from the driver interface 30 to the latch 31, the D/A converter 32 and the drive 33 so as to control the latch 31, the output timing of the D/A converter 32, and the precharge operation by the drive 33. The driving current output from the drive 33 is output to a data line via an output circuit 34. Typically, a plurality of sets of the driver illustrated in FIG. 8 are provided for the data lines 3 (3*a*, 3*b*, 3*c*, 3*d*, 3*e*, etc.) for supplying the driving current.

Then, scanning line driving signals are successively turned ON to successively scan the $n^{th}$ and $n+1^{th}$ scanning lines, as illustrated in FIG. 9. A data line driving signal is output in synchronization with the operation of driving the scanning lines. The change of a driving signal for a particular data line is shown. A precharge operation is performed when the driving operation proceeds from a scanning line to the next scanning line. The precharge period in FIG. 9 and FIG. 10 is a period during which the switches 25 (25*a*, 25*b*, 25*c*, 25*d*, 25*e*, etc.), illustrated in FIG. 2, are turned to the voltage retaining circuit 22 side so that all of the data lines 3 (3*a*, 3*b*, 3*c*, 3*d*, 3*e*, etc.) are connected to the voltage retaining circuit 22. During the precharge period, there is no substantial influence on the current of the driving current source because the amount of charge of the parasitic capacitor is large.

During the precharge period, the parasitic capacitor of each organic EL element 1 is charged to a black level. When a driving current is supplied after the precharge period, the data line voltage starts increasing immediately because the parasitic capacitor has already been charged, whereby the EL current flowing through the organic EL element 1 accordingly increases to illuminate the organic EL element 1.

As described above, according to the present invention, prior to the supply of the driving current, the charge stored in pixels that have been illuminated during the previous scanning step is allowed to flow into the parasitic capacitor of each pixel. In this way the parasitic capacitor of each pixel is charged to a potential equal to or less than a potential that is determined to be a black level. As a result, when the driving current is supplied from the data line driving circuit, the voltage of the data line quickly increases for the selected pixels to initiate the illumination of the organic EL elements. Therefore, a sufficient illumination time to obtain a high brightness is ensured. As a result, it is possible to obtain a high brightness. Moreover, according to the present invention, the effects as described above can be realized only by providing the Zener diode, and connecting each data line to the Zener diode when the scanning operation proceeds to the next scanning line. Thus, it is possible to realize the organic EL display device with a high level of brightness with a very simple circuit configuration. Moreover, the current efficiency is very high because the charge stored in the parasitic capacitors of the organic EL elements that have been illuminated during the previous scanning step is collected and used to charge the parasitic capacitors of all of the pixels.

What is claimed is:

1. An organic EL display device, comprising:

a plurality of organic EL elements arranged in a matrix pattern;

a plurality of scanning lines each connected to a row of the organic EL elements;

a plurality of data lines each connected to a column of the organic EL elements;

a scanning line driving circuit for successively scanning said scanning lines;

a data line driving circuit for applying a driving current to a selected data line in synchronization with the scanning operation of said scanning line driving circuit;

a Zener diode capable of retaining a voltage in a range for a black level of said organic EL elements;

a switch provided between each of said data lines and said Zener diode for either commonly connecting said data lines to said Zener diode or disconnecting said data lines from one another and from said Zener diode; and a control circuit for turning on all of the switches to connect all of the data lines to one another and to the Zener diode when the scanning operation by said scanning line driving circuit proceeds from one scanning line to the next scanning line.

2. The organic EL display device according to claim 1, further comprising a capacitor connected in parallel with said Zener diode.

3. The organic EL display device according to claim 2, wherein said switch selectively connects said data line to said Zener diode or brings said data line into a floating state.

4. The organic EL display device according to claim 2, wherein said scanning line driving circuit comprises a scanning line switch, for each of said scanning lines, for selectively connecting said scanning line to a scanning line power source or to a ground.

5. The organic EL display device according to claim 2, wherein said data line driving circuit comprises:

a signal current source provided for each of said data lines; and a data line power source for applying a driving voltage to said data line via said signal current source.

6. The organic EL display device according to claim 5, wherein when the scanning operation by the scanning line driving circuit proceeds from the one scanning line to the next scanning line, said control circuit connects a scanning line switch connected to the next scanning line to a ground, connects all scanning line switches connected to the other scanning lines to said scanning line power source, and turns off all of said switches.

7. The organic EL display device according to claim 1, wherein said switch selectively connects said data line to said Zener diode or brings said data line into a floating state.

8. The organic EL display device according to claim 1, wherein said scanning line driving circuit comprises a scanning line switch, for each of said scanning lines, for selectively connecting said scanning line to a scanning line power source or to a ground.

9. The organic EL display device according to claim 1, wherein said data line driving circuit comprises:

a signal current source provided for each of said data lines; and a data line power source for applying a driving voltage to said data line via said signal current source.

10. The organic EL display device according to claim 9, wherein when the scanning operation by the scanning line driving circuit proceeds from the one scanning line to the next scanning line, said control circuit connects a scanning line switch connected to the next scanning line to a ground, connects all scanning line switches connected to the other scanning lines to said scanning line power source, and turns off all of said switches.

11. A method for driving an organic EL display device, wherein said device comprises:

a plurality of organic EL elements arranged in a matrix pattern;

a plurality of scanning lines each connected to a row of the organic EL elements;

a plurality of data lines each connected to a column of the organic EL elements;

a scanning line driving circuit for successively scanning said scanning lines;

a data line driving circuit for applying a driving current to a selected data line in synchronization with the scanning operation by said scanning line driving circuit;

a Zener diode capable of retaining a voltage in a range for a black level of said organic EL elements; and a switch provided between each of said data lines and said Zener diode, said method comprising the step of:

turning on all of said switches to connect all of said data lines to one another and to said Zener diode so as to charge parasitic condensers of said organic EL elements to a voltage that is determined by said Zener diode when the scanning operation by said scanning line driving circuit proceeds from one scanning line to the next scanning line.

12. The method for driving an organic EL display device according to claim 11, wherein a capacitor is connected in parallel to said Zener diode.

13. The method for driving an organic EL display device according to claim 12, wherein said switch either commonly connects said data lines to said Zener diode or disconnects said data lines from one another and from said Zener diode.

14. The method for driving an organic EL display device according to claim 12, wherein said scanning line driving circuit selectively connects each of the scanning lines to a scanning line power source or to a ground by means of a scanning line switch.

15. The method for driving an organic EL display device according to claim 12, wherein said data line driving circuit controls a driving current to be supplied from a signal current source to said data line.

16. The method for driving an organic EL display device according to claim 15, wherein when the scanning operation by said scanning line driving circuit proceeds from one scanning line to the next scanning line, a scanning line switch connected to the next scanning line is connected to a ground, all other scanning line switches are connected to the scanning line power source, and all of said switches are turned off to disconnect said data lines from one another and from said Zener diode.

17. The method for driving an organic EL display device according to claim 11, wherein said switch either commonly connects said data lines to said Zener diode or disconnects said data lines from one another and from said Zener diode.

18. The method for driving an organic EL display device according to claim 11, wherein said scanning line driving circuit selectively connects each of the scanning lines to a scanning line power source or to a ground by means of a scanning line switch.

19. The method for driving an organic EL display device according to claim 11, wherein said data line driving circuit controls a driving current to be supplied from a signal current source to said data line.

20. The method for driving an organic EL display device according to claim 19, wherein when the scanning operation by said scanning line driving circuit proceeds from one scanning line to the next scanning line, a scanning line switch connected to the next scanning line is connected to a ground, all other scanning line switches are connected to the scanning line power source, and all of said switches are turned off to disconnect said data lines from one another and from said Zener diode.

* * * * *